US005402561A

United States Patent [19]

Cerquone et al.

[11] Patent Number: 5,402,561

[45] Date of Patent: Apr. 4, 1995

[54] CRIMPING TOOL HAVING ANGULARLY OFFSET CRIMPING DIES

[75] Inventors: Stephen M. Cerquone; Timothy L. Elbin; Richard L. Oskowis, all of Harrisburg; Joseph F. Stachura, Lebanon, all of Pa.

[73] Assignee: The Whitaker Corporation, Wilmington, Del.

[21] Appl. No.: 148,755

[22] Filed: Nov. 5, 1993

[51] Int. Cl.[6] ..... H01R 43/042; B21D 7/06

[52] U.S. Cl. ..... 29/751; 29/268; 29/566.4; 7/107; 72/410

[58] Field of Search ..... 29/33 M, 268, 566.3, 29/566.4, 749, 750, 751; 7/107; 72/409, 410; 81/418, 420–426.5

[56] References Cited

U.S. PATENT DOCUMENTS

| | | | |
|---|---|---|---|
| 4,174,560 | 11/1979 | Senior et al. | 29/33 M X |
| 4,227,299 | 10/1980 | Kuehling | 29/751 |
| 4,429,451 | 2/1984 | Angelico | 29/566.4 |
| 4,480,374 | 11/1984 | Meyer | 29/566.4 |
| 4,607,544 | 8/1986 | Jewell, Jr. | 81/420 X |
| 4,625,386 | 12/1986 | Bieganski | 29/566.4 |
| 4,713,874 | 12/1987 | Schwartz | 29/751 X |
| 4,862,580 | 9/1989 | Wang et al. | 29/566.4 |
| 4,981,032 | 1/1991 | Chen | 7/107 X |
| 5,012,666 | 5/1991 | Chen et al. | 72/410 |
| 5,063,770 | 11/1991 | Chen | 81/421 X |
| 5,109,591 | 5/1992 | Hung | 29/566.4 |
| 5,214,842 | 6/1993 | Chen | 29/749 |

OTHER PUBLICATIONS

"Hand Assembly Tool For Modular Plugs" Miller et al, Western Electric, Technical Digest No. 53, Jan. 1979, p. 15.

*Primary Examiner*—Peter Dungba Vo

*Attorney, Agent, or Firm*—Robert J. Kapalka

[57] ABSTRACT

A tool for applying an electrical connector to an electrical cable comprises a pair of jaws relatively pivotable on a pivot axis between closed and a range of open positions. A first one of the jaws has a support surface configured to receive a bottom surface of the connector thereon, with the support surface defining a support plane for the connector. A second one of the jaws defines a nest for the connector, the nest having side walls disposed in respective planes at respective different distances from the pivot axis of the jaws. The side walls are arranged such that when the jaws are in the closed position the respective planes of the side walls are angularly offset from perpendicular to the plane of the support surface, and when the jaws are at some open position, the respective planes of the side walls are perpendicular to the plane of the support surface.

9 Claims, 6 Drawing Sheets

CRIMPING TOOL HAVING ANGULARLY OFFSET CRIMPING DIES

FIELD OF THE INVENTION

The invention relates to the field of tools having relatively pivotable jaws for crimping an electrical connector to a cable, and in particular, to a hand tool having pivotable jaws for crimping a communication type modular plug to communication cable.

BACKGROUND OF THE INVENTION

Modular plugs are well-known in the communications industry to permit simple electrical connection and disconnection of communication devices. The modular plugs typically have four, six or eight contacts which are engageable with individual wires of a communication cable received in the plug. The contacts are narrow conductive members which are disposed in initial positions in slots in the plug. The contacts are driven along respective axes of motion into engagement with their respective wires in a crimping operation wherein the contacts are caused to pierce the insulation of their respective wires and to electrically engage the conductive wire core.

Crimping tools are known for driving the contacts of a modular plug into engagement with their respective wires. These crimping tools have a die set comprising a pair of cooperating dies which are driven relatively together, one of the dies having a plurality of indenters which engage the contacts to force the contacts into engagement with the communication cable. Such crimping tools generally have a pair of relatively pivotable handle members which are connected so as to provide a mechanical advantage for driving the dies relatively together.

Many of the known crimping tools have the die set arranged so as to receive the modular plug with the communication cable extending substantially parallel to the handle pivot axis and the contacts arranged in an array at slightly different radial distances from the pivot axis. Such an arrangement provides a relatively narrow tool and enables a tool operator to easily see when the modular plug is properly positioned between the die set prior to a crimping operation. In its simplest form, such a tool has the handle members pivotally attached in a pliers-like arrangement with the die set at a remote end thereof. As the handles are pivoted during a crimping operation the indenters move along an arcuate path and, as the indenters drive the contacts along their respective axes of motion the indenters also slide across the tips of the contacts in a direction transverse to the axes of motion. This results in a problem in that the transverse motion of the indenters tends to rotate the modular plug and may result in binding of the modular plug in the tool and/or binding of the contacts in their slots and/or incomplete engagement of the contacts with their respective wires.

Various tool constructions have been developed in order to overcome this problem. These tools typically have a crimping die on a separate movable block which is guided for straight line motion along a path normal to a nest for the plug. See, for example, U.S. Pat. No. 4,429,451 to Angelico; 4,480,374 to Meyer; and 4,862,580 to Wang et al. These tools have pivotable handles which are operable to move a roller or cam-like actuator against the block. In each of these tools the roller or cam-like actuator moves partially across a face of the block during a crimping operation, thereby resulting in friction and wear. Further, these tools are relatively complex and expensive to manufacture. There is a need for a simple hand operable crimping tool which overcomes the problems associated with the prior art crimping tools and ensures a reliable and secure connection of a modular plug with a communication cable.

SUMMARY OF THE INVENTION

A tool according to the invention is usable for applying an electrical connector to an electrical cable wherein the connector comprises a housing having a bottom surface defining a plane and a pair of opposite side surfaces extending perpendicular to the plane of the bottom surface, and the housing carries at least one contact disposed in an initial position and drivable toward the plane of the bottom surface to a final position wherein the at least one contact makes electrical connection with a conductor of the cable. The tool comprises a pair of jaws relatively pivotable on a pivot axis between open and closed positions. A first one of the jaws has a support surface configured to receive the bottom surface of the housing thereon, with the support surface defining a support plane. A second one of the jaws defines a nest for the housing, the nest having side walls disposed in respective planes and arranged to confine the housing therebetween with the side surfaces of the housing at respective different distances from the pivot axis of the jaws. The second one of the jaws carries at least one indenter disposed to engage the at least one contact when a connector is disposed in the nest and to drive the at least one contact from the initial position to the final position as the jaws are pivoted from the open position to the closed position. The side walls of the nest are arranged such that when the at least one indenter engages the at least one contact in the initial position, the respective planes of the side walls are perpendicular to the plane of the support surface, and when the jaws are closed and the at least one contact is in the final position, the respective planes of the side walls are angularly offset from perpendicular to the plane of the support surface.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION OF THE PREFERRED EMBODIMENT

Figure 2:
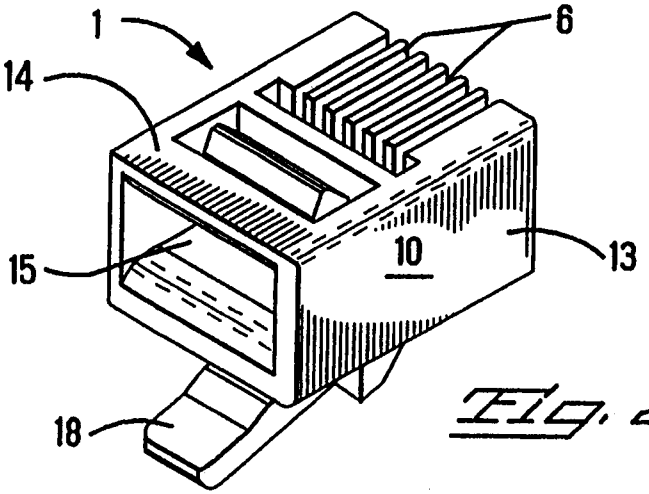
FIG. 2 is a perspective view of the modular plug from a different direction.
Figure 4:
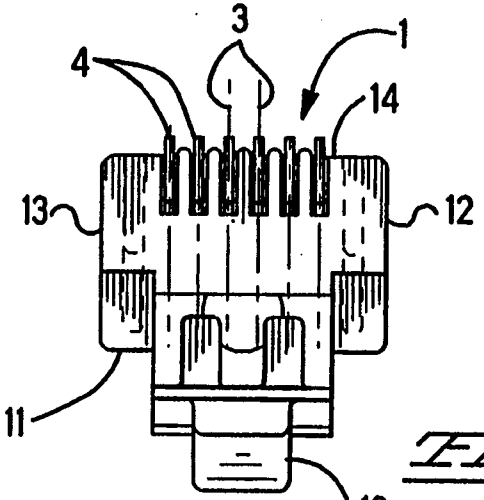
FIG. 4 is a front view of the modular plug.
Figure 1:
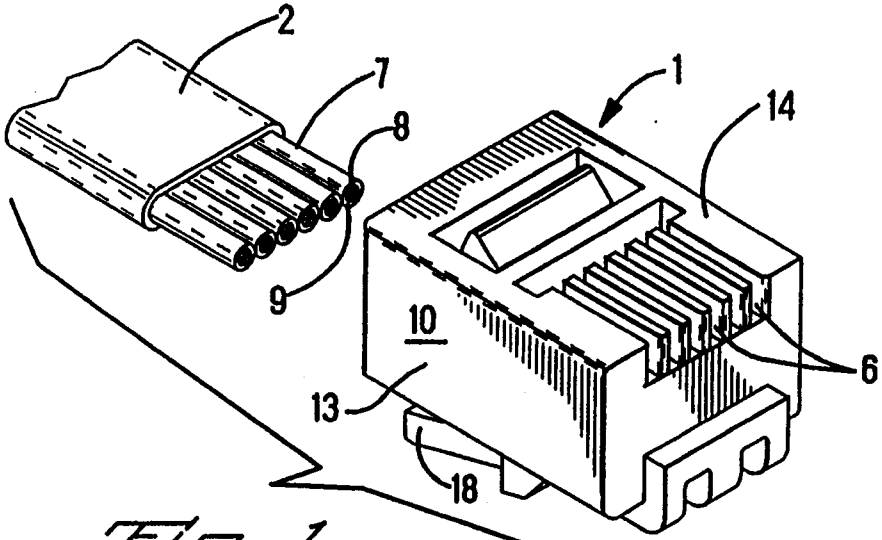
FIG. 1 is a top perspective view of a modular plug which can be applied to a cable by a tool according to the invention.
Figure 3:
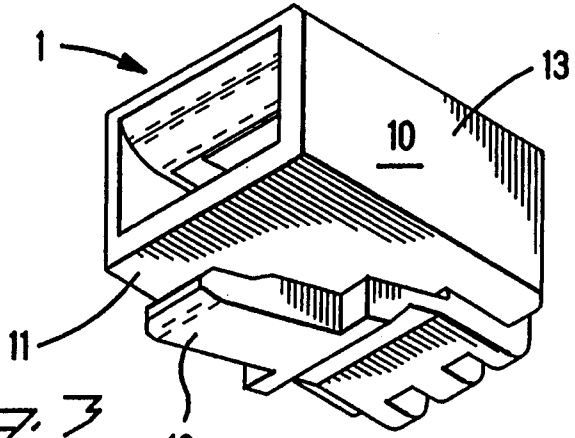
FIG. 3 is a bottom perspective view of the modular plug.
Figure 5:
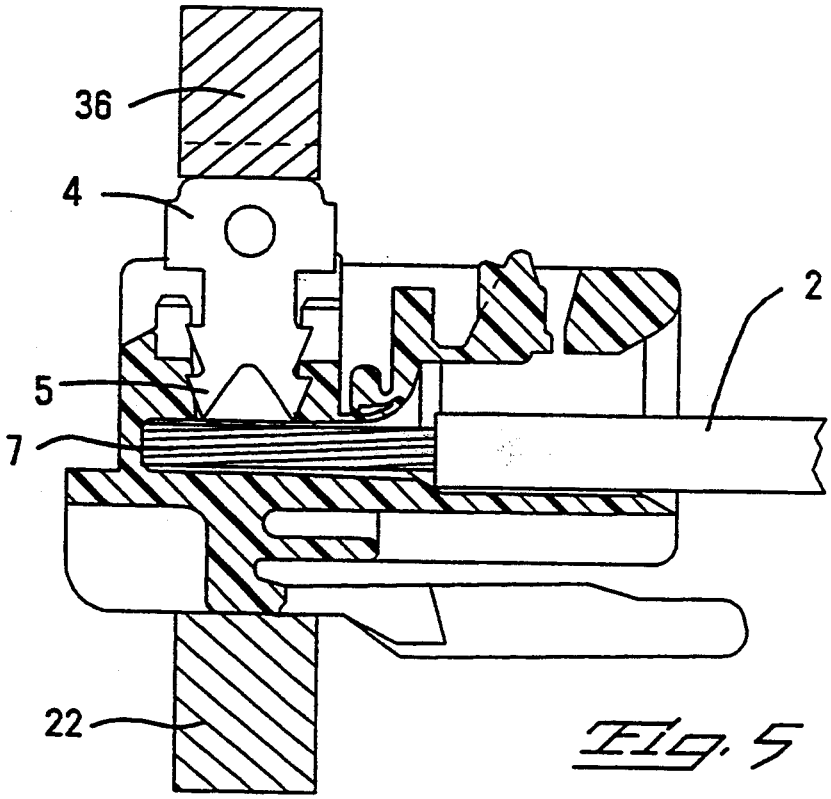
FIG. 5 is a cross-sectional view of the modular plug with a contact in an initial position.
Figure 6:
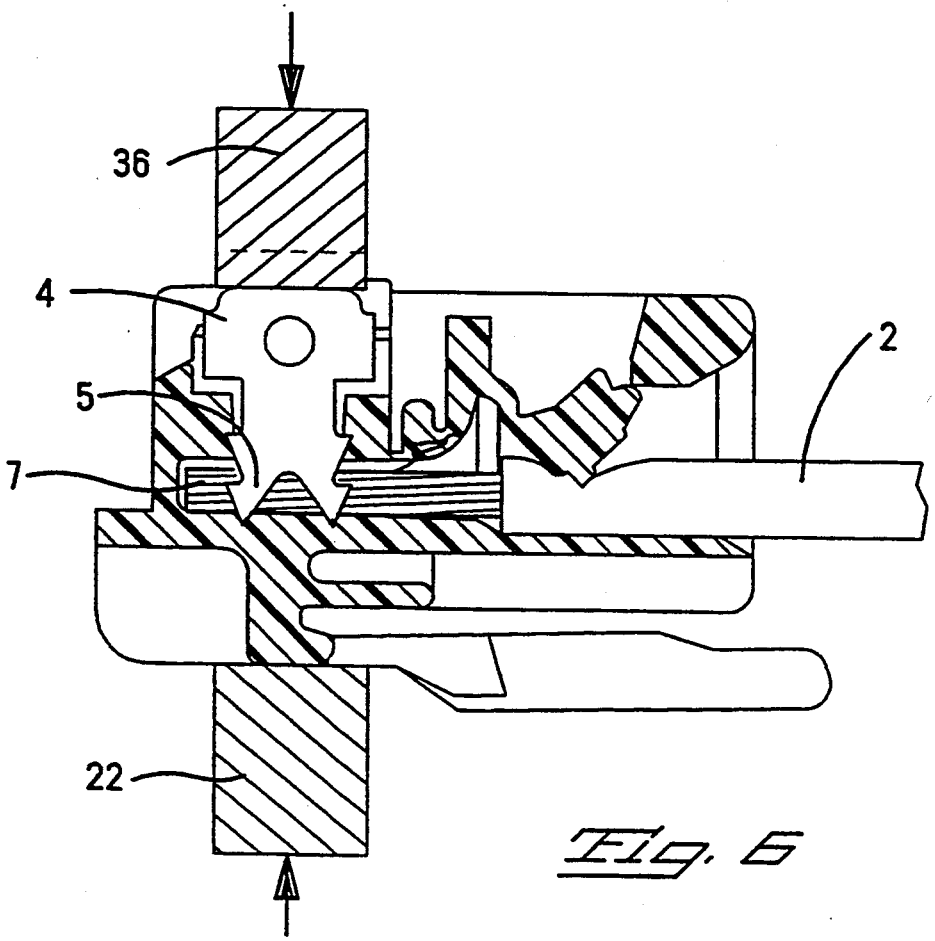
FIG. 6 is a cross-sectional view of the modular plug with a contact having been driven into a wire conductor.
Figure 7:
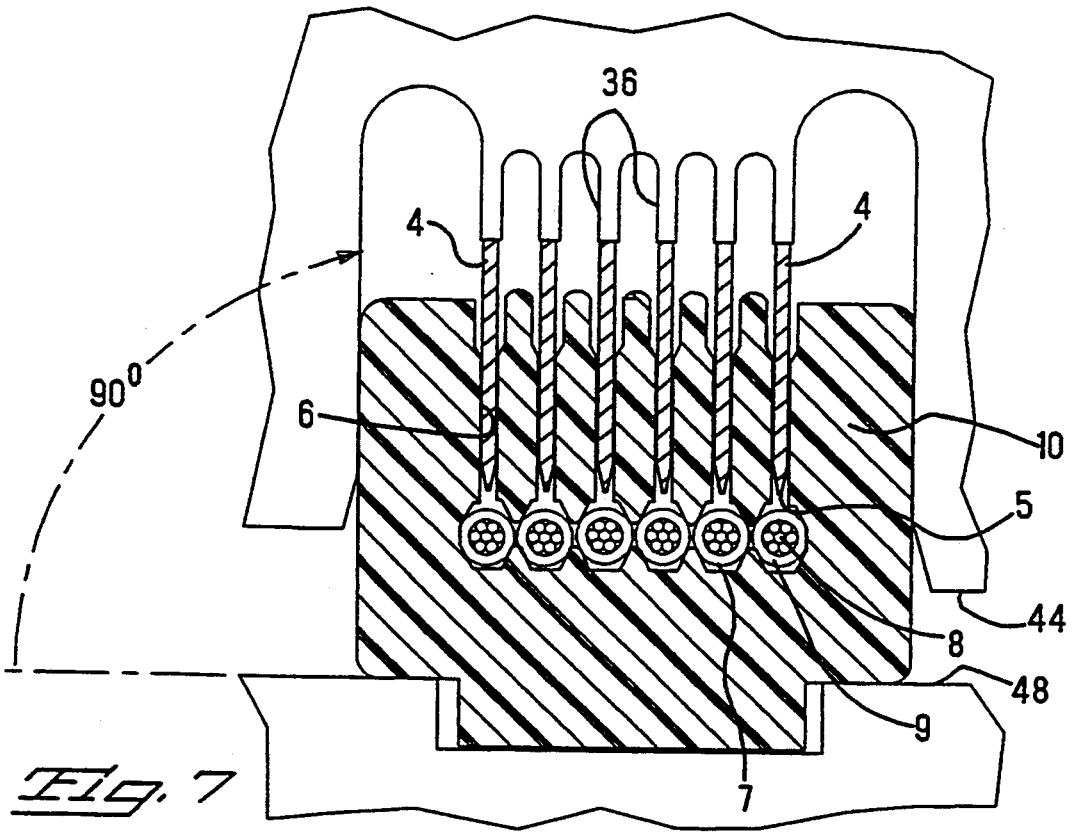
FIG. 7 shows a modular plug about to be crimped between crimping dies of a tool according to the invention.
Figure 8:
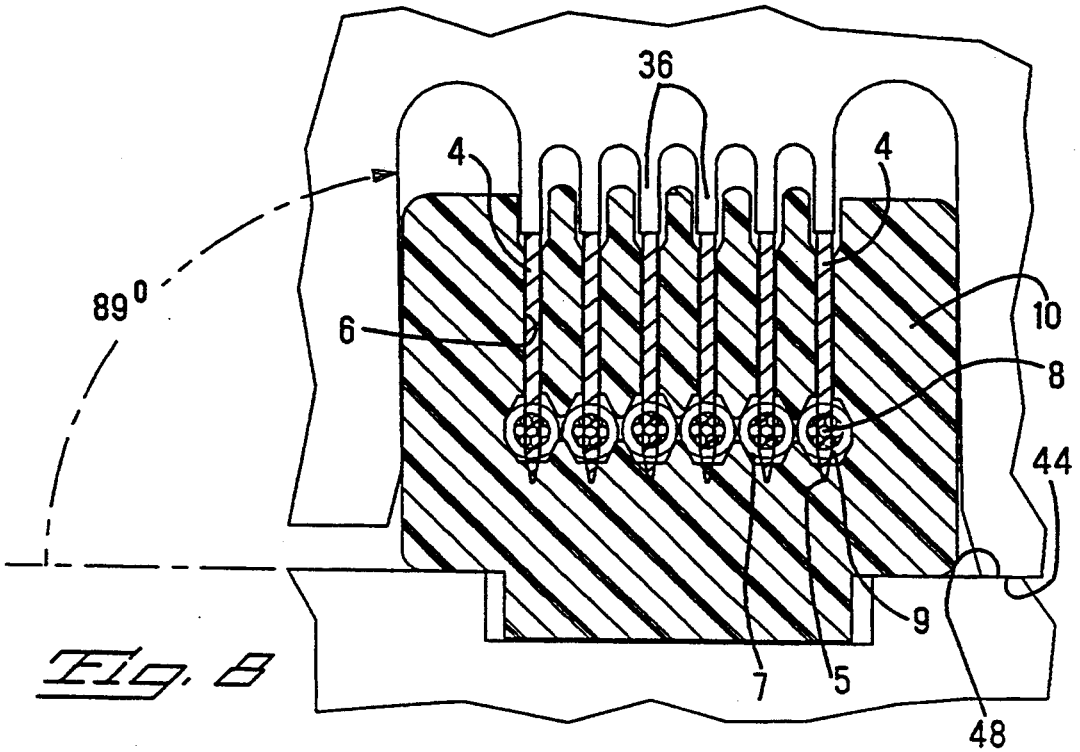
FIG. 8 shows a modular plug after being crimped between crimping dies of a tool according to the invention.

A tool according to the invention is useful for applying an electrical connector to an electrical cable, and in a preferred embodiment is especially adapted for applying a communication-type modular plug as shown in FIGS. 1–4 to a communication cable. The modular plug shown generally by reference numeral 1 comprises a dielectric housing 10 having bottom surface 11, side surfaces 12, 13, and top surface 14. The bottom surface 11 defines a plane, and the side surfaces 12, 13 extend perpendicular to plane of the bottom surface 11. The housing 10 carries at least one contact 4 and typically carries four, six or eight of the contacts 4, the representative housing 10 shown in the drawings having six of the contacts 4. The contacts 4 are frictionally held in respective slots 6 in respective initial positions. The housing 10 has a cavity 15 which extends interiorly to beneath the slots 6. An end of a cable 2 having insulation stripped therefrom to expose a number of individual wires 7 corresponding to the number of contacts 4 is insertable into the cavity 15 until the wires 7 are positioned beneath tips 5 of the contacts 4, as shown in FIGS. 5 and 7. Each of the wires 7 has a conductive core 8 surrounded by insulation 9. The contacts 4 are drivable within the slots 6 by the tool of the present invention to respective final positions as shown in FIGS. 6 and 8 wherein the tips 5 of the contacts 4 pierce the insulation 9 surrounding each of the wires 7 and make electrical connection with the conductive cores 8 of their respective wires 7. The slots 6 are configured to guide their respective contacts 4 along respective axes of motion 3 perpendicular to the plane defined by the bottom surface 11 during a crimping stroke of the tool. A latching arm 18 which depends from the housing 10 is of a standard type which enables removable retention of the modular plug in, for example, a telephone jack, a telephone base or a receiver handset.

Figures 9, 10:
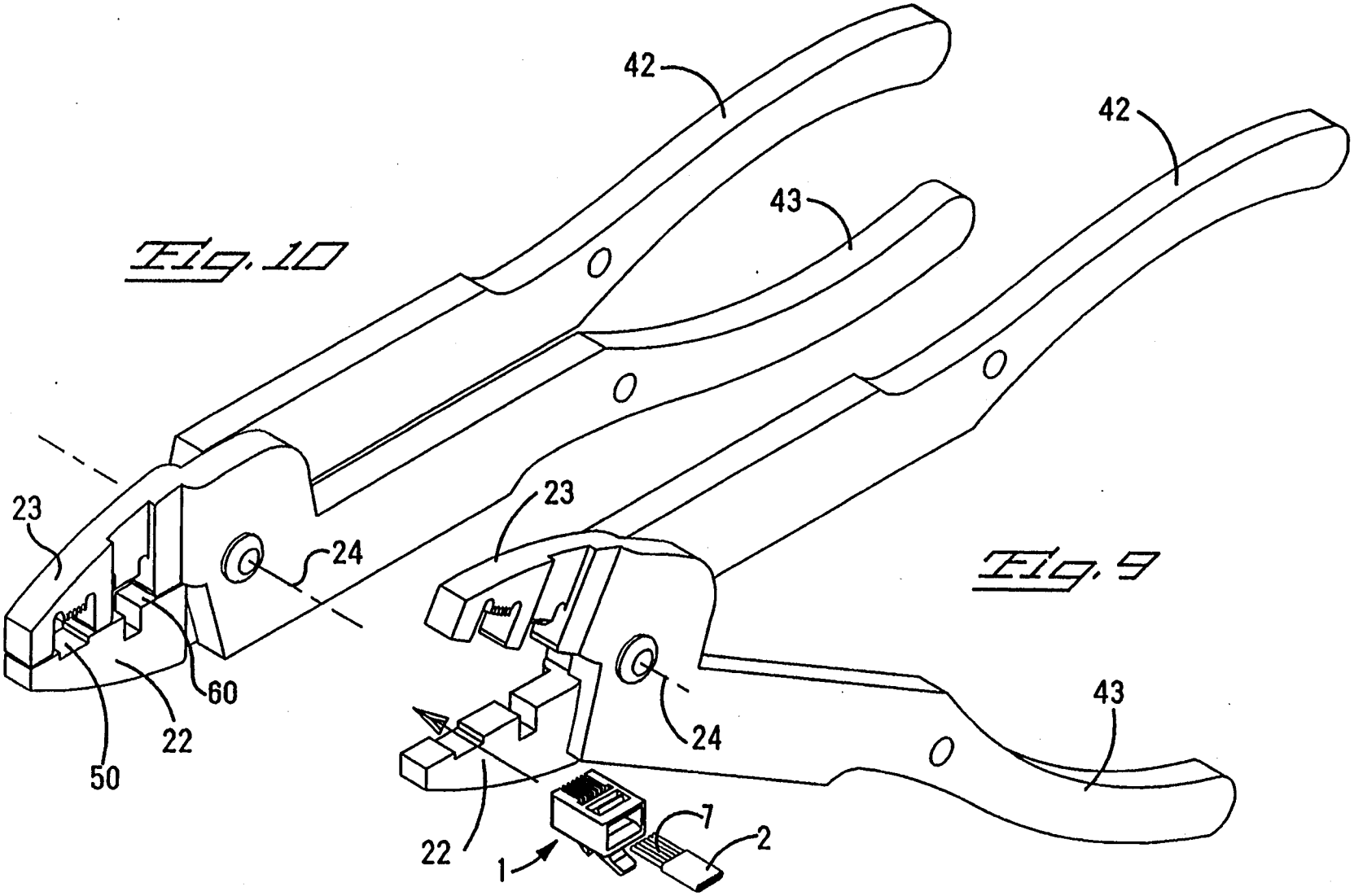
FIG. 9 is an overall view of a tool according for crimping a modular plug according to the invention.
FIG. 10 is a view of the tool in the closed position.
Figure 11:
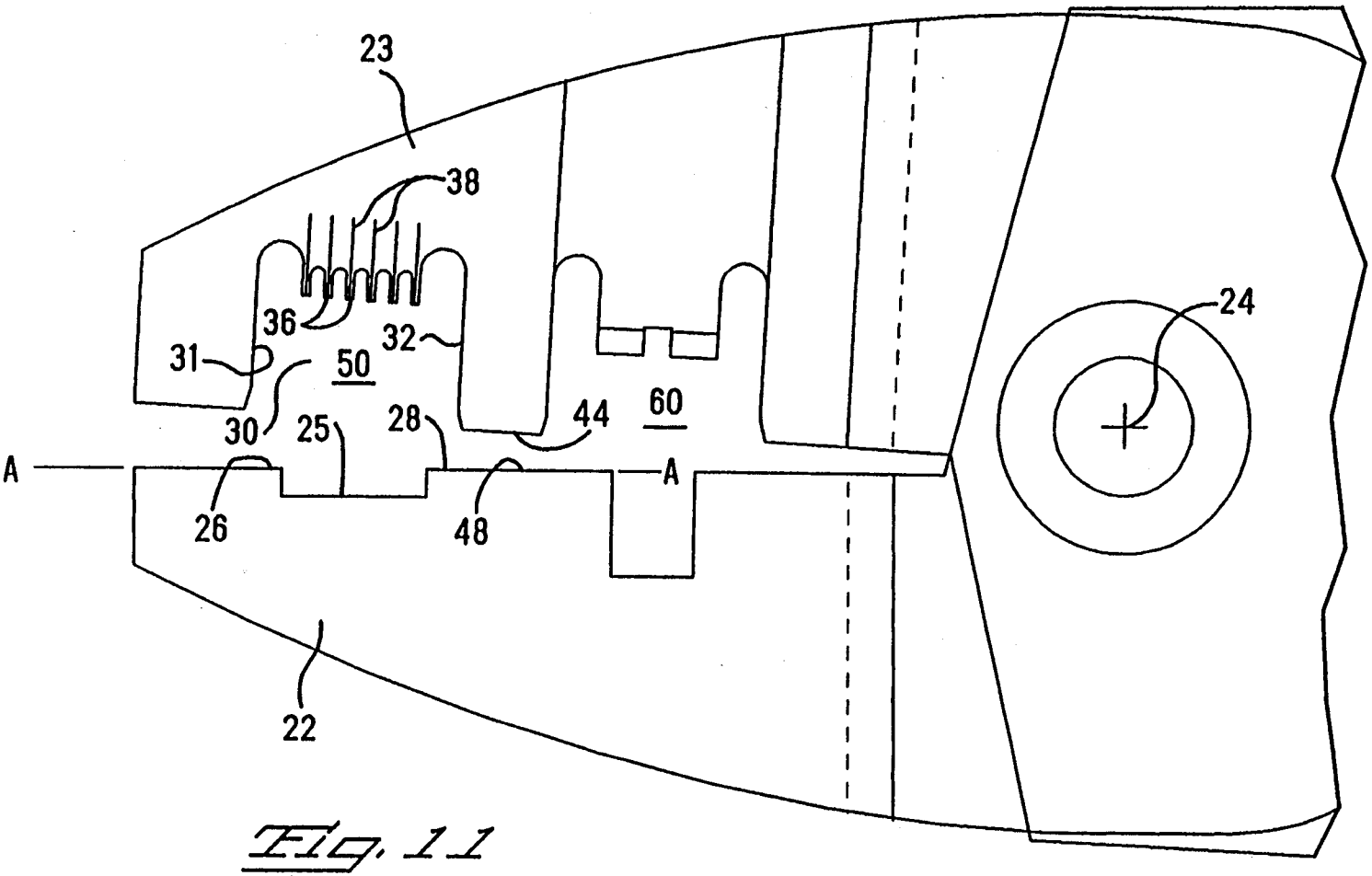
FIG. 11 is an enlarged view of the crimping jaws of the tool according to the invention.

As shown in FIGS. 9 and 10, the tool of the present invention has a simple pliers-like construction wherein a pair of unitary members which are relatively pivotal on a pivot axis 24 define a pair of handles 42, 43 and a pair of jaws 22, 23, the handles being operable to pivot the jaws between an open position shown in FIG. 10 and a closed position shown in FIG. 11. In the preferred embodiment shown, the jaws 22, 23 cooperate to define a conductor crimping zone 50 which encompasses a novel feature of the present invention, and an insulation crimping zone 60 which, although it does not form a part of the present invention, is preferentially incorporated in the tool.

Figure 12:
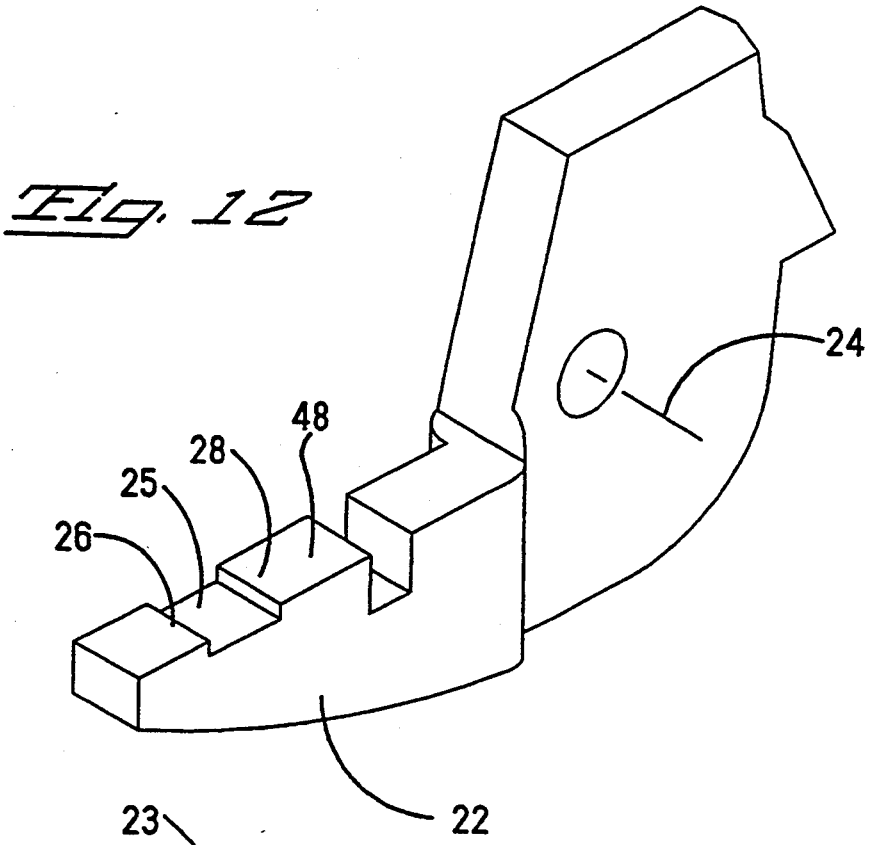
FIG. 12 is a perspective view of one crimping jaw of the tool.

Referring now to FIGS. 11 and 12, a portion of the conductor crimping zone 50 defined by a first one of the jaws 22 includes working surfaces which are configured complementary to the bottom 11 of the housing 10. The working surfaces include a pair of housing support surfaces 26, 28 which receive the bottom surface 11 of the housing thereon, it being understood that the pair of surfaces 26, 28 are necessarily spaced apart to provide clearance for the latching arm 18 of the modular plug, but nevertheless the pair of surfaces 26, 28 comprise a single support surface or seat for the modular plug with which the tool is adapted to be used. During a crimping operation, the surfaces 26, 28 receive a load transferred through the housing 10 by the jaw 23 acting to drive the contacts 4 into engagement with the conductors. The surfaces 26, 28 are aligned in a plane and thereby define a plane of support A—A for the housing 10.

The working surfaces of the first jaw 22 further include a recessed surface 25 which is spaced sufficiently below the support surfaces 26, 28 to provide a recess which accommodates the latching arm 18 of the modular plug, the recess being dimensioned sufficiently large to avoid imparting any significant load on the latching arm 18 during a crimping procedure.

A fully closed position of the jaws is defined by abutment of jaw surfaces 44 and 48 which prevent the housing 10 from being crushed by application of excessive force to the handle members 41, 42.

Figure 13:
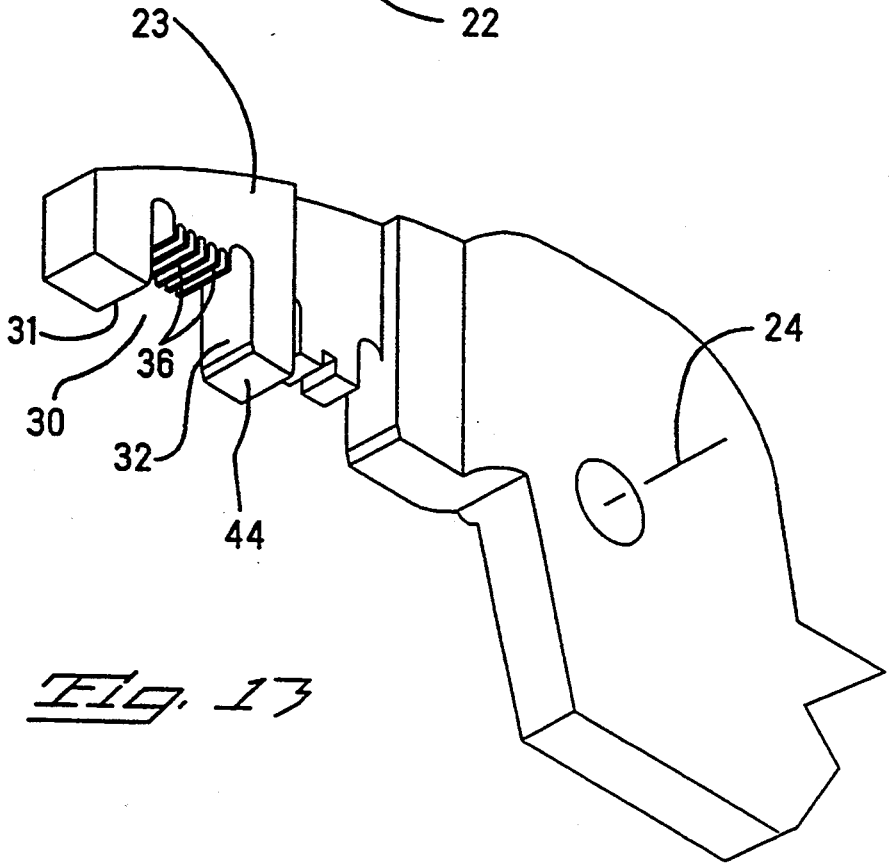
FIG. 13 is a perspective view of the other crimping jaw of the tool.

Referring to FIGS. 11 and 13, a portion of the conductor crimping zone 50 defined by a second one of the jaws 23 defines a nest 30 which is configured complementary to top surface 14 and side surfaces 12, 13 of the housing 10. The nest has side walls 31, 32 which are arranged in respective planes at respective different distances from the pivot axis 24 of the jaws. The side walls 31, 32 are spaced apart by a dimension selected to confine the side surfaces 12, 13 of the housing therebetween with the side surfaces 12, 13 preferably having a one-thousandth inch clearance between the side walls 31, 32 but, due to manufacturing tolerances, the side surfaces may have a clearance of several thousandths of an inch or may have a slight interference fit between the side walls 31, 32.

The second jaw carries in association with the nest 30 at least one indenter 36, and preferably carries a same number of the indenters 36 as the number of contacts 4 carried by the modular plug with which the tool is intended to be used. The indenters 36 extend in the pivot plane of the jaws along respective indenter axes 38 and are arranged to engage respective ones of the contacts 4 when a modular plug is disposed in the nest 30.

In order to apply a modular plug to a cable using the tool of the present invention, a tool operator begins by applying the modular plug loosely to the end of a cable from which the insulation has been stripped to expose the individual wires of the cable. As shown in FIG. 9, the housing 10 of a modular plug having the cable 2 loosely inserted therein is introduced into the conductor crimping zone 50 between the jaws 22, 23 when the jaws are in the open position. The jaws need only be partially open in order to insert the housing 10 into the nest 30 of the second jaw with the cable 2 extending substantially parallel to the pivot axis 24. As the operator the closes the jaws, the indenters 36 engage the contacts 4 in their initial positions as shown in FIG. 5 and 7. Further closing of the jaws drives the contacts 4 within their slots 6 toward the plane A—A of the support surface 26, 28, whereby the tips 5 of the contacts 4 pierce the insulation 9 surrounding the individual wires 7. When the jaws are completely closed, the tips 5 extend into the conductive cores and make electrical connection therewith, the tips finally residing approximately as shown in FIGS. 6 and 8 when the surfaces 44, 48 of the jaws are in abutment.

Due to the pivotal connection between the jaws 22, 23, the nest 30 experiences a changing angular relationship with respect to the plane A—A of the support surface as the contacts 4 are driven toward the plane. As the indenters 26 move in an arcuate path about the pivot axis 24, the indenters have a first component of motion perpendicular to the plane A—A, and a second component of motion parallel to the plane A—A. This second component of motion imparts a transverse force on the contacts 4 which tends to tilt or rotate the entire housing 10 between the jaws 22, 23 as the contacts are driven within their slots. In order to compensate for this, the nest 30 is arranged so that it is angularly offset from the support plane A—A when the jaws 22, 23 are fully closed. In particular, the side walls 31, 32 of the nest are arranged to be perpendicular to the support plane A—A when the when the jaws 22, 23 are partially open and the indenters 26 first engage the contacts 4 in their initial positions as shown in FIG. 7. As the jaws 22, 23 are pivoted about the axis 24 to drive the contacts 4 to their final positions as shown in FIG. 8, the side walls 31, 32 become angularly offset from perpendicular to the support plane A—A. This arrangement is an improvement over the prior art wherein the side walls are offset from perpendicular to the support plane during initial engagement of the contacts by the indenters, and the side walls finally become perpendicular to the support plane when the jaws are fully closed. It has been found that an angular offset of one degree from perpendicular is sufficient and desirable to virtually eliminate the tendency of the modular plug to rotate between the jaws during a crimping operation.

While the side walls 31, 32 are angularly offset from the support plane A—A, the axes 38 of the indenters may or may not be similarly offset. Applicants have found that a tool wherein the side walls 31, 32 are angularly offset from the support plane but the indenters are perpendicular to the support plane when the jaws are fully closed is very effective for maintaining stability of the modular plug during crimping and providing good engagement of the contacts with their respective wires.

The invention has the advantages of providing a simple and economical hand tool for applying a modular plug to a communication cable. The tool has pivoting crimping jaws with a unique arrangement of crimping dies which provide a more favorable alignment of the indenters with their respective contacts during a crimping operation. The crimping dies are angularly offset as compared to the crimping dies of prior art tools, and the angular offset reduces transverse forces on the modular plug which in the prior art tools tend to rotate the modular plug during the crimping operation.

The invention having been disclosed, a number of variations will now become apparent to those skilled in the art. Whereas the invention is intended to encompass the foregoing preferred embodiment as well as a reasonable range of equivalents, reference should be made to the appended claims rather than the foregoing discussion of examples, in order to assess the scope of the invention in which exclusive rights are claimed.

We claim:

1. A tool for applying an electrical connector to an electrical cable, the connector comprising a housing having a bottom surface defining a plane and a pair of opposite side surfaces extending perpendicular to the plane, the housing carrying at least one contact disposed in an initial position and drivable toward the plane of the bottom surface to a final position wherein the at least one contact makes electrical connection with a conductor of the cable, the tool comprising:

a pair of jaws relatively pivotable on a pivot axis between open and closed positions, a first one of the jaws having a support surface configured to receive the bottom surface of the housing thereon, the support surface defining a support plane, a second one of the jaws defining a nest for the housing, the nest having side walls disposed in respective planes and arranged to confine the housing therebetween with the side surfaces of the housing at respective different distances from the pivot axis of the jaws, the second one of the jaws carrying at least one indenter disposed to engage a respective said at least one contact when a connector is disposed in the nest and the jaws are pivoted from the open to the closed position, thereby driving said respective at least one contact from the initial to the final position, the side walls being arranged such that when the at least one indenter engages said respective at least one contact in the initial position the respective planes of the side walls are perpendicular to the plane of the support surface, and when the jaws are closed and said respective at least one contact is in the final position the respective planes of the side walls are angularly offset from perpendicular to the plane of the support surface.

2. The tool according to claim 1, wherein the at least one indenter extends along an axis parallel to the planes of the side walls.

3. The tool according to claim 1, wherein the at least one indenter extends along an axis that is angularly offset from the planes of the side walls.

4. A tool for applying an electrical connector to an electrical cable, the connector comprising a housing having a bottom surface defining a plane and a pair of opposite side surfaces extending perpendicular to the plane, the housing carrying at least one contact disposed in an initial position and drivable toward the plane of the bottom surface to a final position wherein the at least one contact makes electrical connection with a conductor of the cable, the tool comprising:

a pair of jaws relatively pivotable on a pivot axis between open and closed positions, a first one of the jaws having a support surface configured to receive the bottom surface of the housing thereon, the support surface defining a support plane, a second one of the jaws defining a nest for the housing, the nest having side walls disposed in respective planes and arranged to confine the housing therebetween with the side surfaces of the housing at respective different distances from the pivot axis of the jaws, the second one of the jaws carrying at least one indenter disposed to engage a respective said at least one contact when a connector is disposed in the nest and the jaws are pivoted from the open to the closed position, thereby driving said respective at least one contact from the initial to the final position, the side walls being arranged such that when the jaws are in an intermediate position between the open and closed positions, the respective planes of the side walls are perpendicular to the plane of the support surface, and when the jaws are in the closed position the respective planes of the side walls are angularly offset from perpendicular to the plane of the support surface.

5. The tool according to claim 4, wherein the at least one indenter extends along an axis parallel to the planes of the side walls.

6. The tool according to claim 4, wherein the at least one indenter extends along an axis that is angularly offset from the planes of the side walls.

7. A tool for applying an electrical connector to an electrical cable, the connector comprising a housing having a bottom surface defining a plane and a pair of opposite side surfaces extending perpendicular to the plane, the housing carrying at least one contact disposed in an initial position and drivable toward the plane of the bottom surface to a final position wherein the at least one contact makes electrical connection with a conductor of the cable, the tool comprising:

a pair of jaws relatively pivotable on a pivot axis between closed and a range of open positions, a first one of the jaws having a support surface configured to receive the bottom surface of the housing thereon, the support surface defining a support plane, a second one of the jaws defining a nest for the housing, the nest having side walls disposed in respective planes and arranged to confine the housing therebetween with the side surfaces of the housing at respective different distances from the pivot axis of the jaws, the second one of the jaws carrying at least one indenter disposed to engage a respective said at least one contact when a connector is disposed in the nest and the jaws are pivoted from the open to the closed position, thereby driving said respective at least one contact from the initial to the final position, the side walls being arranged such that when the jaws are in the closed position, the respective planes of the side walls are angularly offset from perpendicular to the plane of the support surface, and when the jaws are at some open position, the respective planes of the side walls are perpendicular to the plane of the support surface.

8. The tool according to claim 7, wherein the at least one indenter extends along an axis parallel to the planes of the side walls.

9. The tool according to claim 7, wherein the at least one indenter extends along an axis that is angularly offset from the planes of the side walls.

* * * * *